US009089784B2

(12) United States Patent
Nelson et al.

(10) Patent No.: US 9,089,784 B2
(45) Date of Patent: Jul. 28, 2015

(54) FILLABLE BALLOON WEIGHT AND BALLOON PEDESTAL DISPLAY

(71) Applicant: Premium Balloon Accessories, Inc., Sharon Center, OH (US)

(72) Inventors: David C Nelson, Akron, OH (US); Wesley A Schroeder, Seville, OH (US)

(73) Assignee: Premium Balloon Accessories, Inc., Sharon Center, OH (US)

( * ) Notice: Subject to any disclaimer, the term of this patent is extended or adjusted under 35 U.S.C. 154(b) by 65 days.

(21) Appl. No.: 13/783,851

(22) Filed: Mar. 4, 2013

(65) Prior Publication Data

US 2014/0248819 A1 Sep. 4, 2014

(51) Int. Cl.
*A63H 3/06* (2006.01)
*A63H 27/10* (2006.01)

(52) U.S. Cl.
CPC ..... *A63H 27/10* (2013.01); *A63H 2027/1008* (2013.01)

(58) Field of Classification Search
USPC ..... 446/111, 220, 221; 434/365, 393; 135/120.3, 135; 248/511, 519, 523; 211/13.1
See application file for complete search history.

(56) References Cited

U.S. PATENT DOCUMENTS

| | | | | | |
|---|---|---|---|---|---|
| 4,378,650 | A * | 4/1983 | Ottoson | 40/607.08 |
| 4,879,823 | A * | 11/1989 | Collins | 40/124.01 |
| 5,021,022 | A * | 6/1991 | Ganz | 446/220 |
| 5,024,011 | A * | 6/1991 | Collins | 40/124.01 |
| 5,334,072 | A * | 8/1994 | Epstein | 446/224 |
| 5,509,540 | A * | 4/1996 | Pomerantz | 211/13.1 |
| 5,690,446 | A * | 11/1997 | Poissant et al. | 403/361 |
| 5,823,365 | A * | 10/1998 | Page | 211/113 |
| 6,364,258 | B1 * | 4/2002 | Naranjo | 248/154 |
| 6,375,534 | B1 * | 4/2002 | Burns | 446/220 |
| 6,631,811 | B2 * | 10/2003 | Komar et al. | 211/13.1 |
| 6,656,063 | B2 * | 12/2003 | Prichard | 473/429 |
| 6,969,295 | B1 * | 11/2005 | Sidwell | 446/220 |
| 7,044,867 | B2 * | 5/2006 | van Nimwegen | 473/481 |
| 2005/0109894 | A1 * | 5/2005 | Lin et al. | 248/166 |
| 2007/0049158 | A1 * | 3/2007 | Chou | 446/220 |
| 2008/0076322 | A1 * | 3/2008 | Phillips | 446/220 |
| 2012/0211634 | A1 * | 8/2012 | Yang et al. | 248/397 |
| 2014/0041204 | A1 * | 2/2014 | Peters et al. | 29/525.11 |

* cited by examiner

*Primary Examiner* — Kurt Fernstrom
(74) *Attorney, Agent, or Firm* — Renner Kenner Greive Bobak Taylor & Weber

(57) ABSTRACT

A balloon display unit is provided to display a single balloon on the end of a stick. These display units can be secured to display bases to provide a balloon display. A balloon display unit includes a balloon and a balloon pedestal, which includes a base and a balloon stick receiving structure extending from the base. The balloon stick receiving structure can received sticks of varying inner and outer diameters. The balloon display includes a display base that receives one or more of the balloon display units.

19 Claims, 6 Drawing Sheets

FILLABLE BALLOON WEIGHT AND BALLOON PEDESTAL DISPLAY

FIELD OF THE INVENTION

This invention resides generally in the field of balloon displays and, in one embodiment, resides in the art of balloon displays that are suitable for displaying a single balloon on the end of a stick. In other embodiments, the present invention resides in the field of balloon weights that are selectively filled with material to provide the mass necessary to restrain a plurality of balloons mounted on sticks.

BACKGROUND OF THE INVENTION

Due to an increased demand for helium, it is becoming difficult to offer helium-filled balloons at prices agreeable to potential balloon consumers. Only a small percentage of the global helium supply is purchased for use in filing balloons, while a much larger percentage (and rising) is purchased for use in other applications, such as cooling the magnets of Magnetic Resonance Imaging (MRI) machines. The MRI industry and others industries willing and capable of purchasing helium at high prices are beginning to drive helium prices beyond what the balloon industry can bear.

As helium prices increase, helium-filled balloon prices increase, and helium-filled balloon demand decreases. Because the lighter-than-air characteristics of a helium-filled balloon are important to the balloon consumer, a suitable substitute should simulate some of the floating, bobbing and weaving characteristics of lighter-than-air balloons. To help simulate some of the characteristics mentioned above of lighter-than-air balloons, the non-helium-filled balloon's can be attached to and held upright by a stick such that the balloon and the stick can be carried around by an individual or set up for a more stationary display, much like a balloon on a string might be carried around or secured to something stationary for display. Therefore there exists a need in the art for a more universal balloon weight (or balloon display) and method that permits a balloon stick and a balloon weight to be used for any given display and display concept.

SUMMARY OF THE INVENTION

A first embodiment of the invention provides a balloon display unit comprising: a balloon and a balloon pedestal including: a base, and a balloon stick receiving structure extending from said base, the balloon stick receiving structure including: a male mounting structure defining an outside mounting periphery, and a female mounting structure defining an inside mounting periphery, wherein the inside mounting periphery of the female mounting structure is shaped to selectively engage a outside periphery of a first balloon stick and thereby secure said first balloon stick to said balloon pedestal, and wherein the outside mounting periphery of the male mounting structure is shaped to receive a inside periphery of a second balloon stick and thereby secure said second balloon stick to said balloon pedestal; and wherein one of said first balloon stick or said second balloon stick has said balloon secured thereto and is engaged with said balloon stick receiving structure.

A second embodiment provides a balloon display unit as in the first embodiment, further comprising a means for securing said base of said balloon pedestal to a surface.

A third embodiment provides a balloon display unit as in either of the first or second embodiments, wherein said means for securing said base is selected from the group consisting of a snap fit system, a adhesive system and a magnet system.

A fourth embodiment provides a balloon display unit as in any of the first through third embodiments, wherein said means for attachment is a pressure sensitive adhesive.

A fifth embodiment provides a balloon display unit as in any of the first through fourth embodiments, wherein said balloon is a non-helium filled balloon.

A sixth embodiment provides a balloon display comprising: a display base having a mounting surface; and a balloon display unit secured to said mounting surface, said balloon display unit comprising: a balloon pedestal including: a base, and a balloon stick receiving structure extending from said base, the balloon receiving structure including a male mounting structure defining an outside mounting periphery and a female mounting structure defining an inside mounting periphery, a balloon stick engaged with one of said outside or inside mounting peripheries; and a non-helium filled balloon secured to said balloon stick.

A seventh embodiment provides a balloon display as in the sixth embodiment, wherein said mounting surface is a top mounting surface opposite a base of the display base, the mounting surface including and opening and the display base including a cap, said cap selectively closing off said opening to close access to the interior volume of said container, wherein the interior volume is selectively filled with a mass to weigh down said container.

An eight embodiment provides a balloon display as in either of the sixth or seventh embodiments, wherein the top mounting surface has pre-determined pedestal receipts to receive balloon pedestals.

A ninth embodiment provides a balloon display as in either of the sixth through eighth embodiments, wherein the cap has the ability to receive a balloon pedestal.

A tenth embodiment provides a balloon display as in any of the sixth through ninth embodiments, wherein the opening is defined in said top mounting surface.

A eleventh embodiment provides a balloon display as in any of the sixth through tenth embodiments, wherein the means of securing the non-helium filled balloon is by way of a balloon cup A twelfth embodiment provides a balloon display comprising: a display base, at least one balloon pedestal, at least one balloon stick, and at least one non-helium filled balloon; wherein the at least one non-helium filled balloon is secured to the at least one balloon stick; wherein the at least one balloon stick is received by the at least one balloon pedestal, and wherein the at least one balloon pedestal is attached to the display base.

A thirteenth embodiment provides a balloon display as in the twelfth embodiment, wherein the balloon display base comprises: a container having a top surface with a open end opposite a base, said open end providing access to an interior volume of said container; and a cap, said cap closing off access to the interior volume of said container; wherein the interior volume of the container has the ability to be filled with a mass to weigh down said container; and wherein the top surface has the ability to receive multiple balloon pedestals.

A fourteenth embodiment provides a balloon display as in either the twelfth or thirteenth embodiment, wherein the at least one balloon pedestal comprises: a pedestal base; and a balloon receiving structure; wherein the balloon receiving structure comprises: a male mounting structure; and a female mounting structure; wherein the pedestal base includes a means of attaching the balloon pedestal to the top surface of a container; wherein a inside mounting periphery of the female mounting structure is shaped to selectively engage a outside periphery of a first balloon stick; and wherein a outside mounting diameter of the male mounting structure is shaped to selectively engage a inside periphery of a second balloon stick.

A fifteenth embodiment provides a balloon display as in any of the twelfth through fourteenth embodiments, wherein the balloon pedestal can be attached to the top surface of the container by the means of attachment chose from the group consisting of a snap fit system, a adhesive system and a magnet system.

A sixteenth embodiment provides a balloon display as in any of the twelfth through fifteenth embodiments, wherein the means of attachment is a pressure sensitive adhesive.

A seventeenth embodiment provides a balloon display as in any of the twelfth through sixteenth embodiments, wherein the means of securing the non-helium filled balloon to the balloon stick is by way of a balloon cup.

A eighteenth embodiment provides a balloon display as in any of the twelfth through seventeenth embodiments, wherein the top surface of the container has pre-determined pedestal receipts to receive balloon pedestals.

A nineteenth embodiment provides a balloon display as in any of the twelfth through eighteenth embodiments, wherein the cap has the ability to receive a balloon pedestal.

DETAILED DESCRIPTION OF ILLUSTRATIVE EMBODIMENTS

Figure 1:
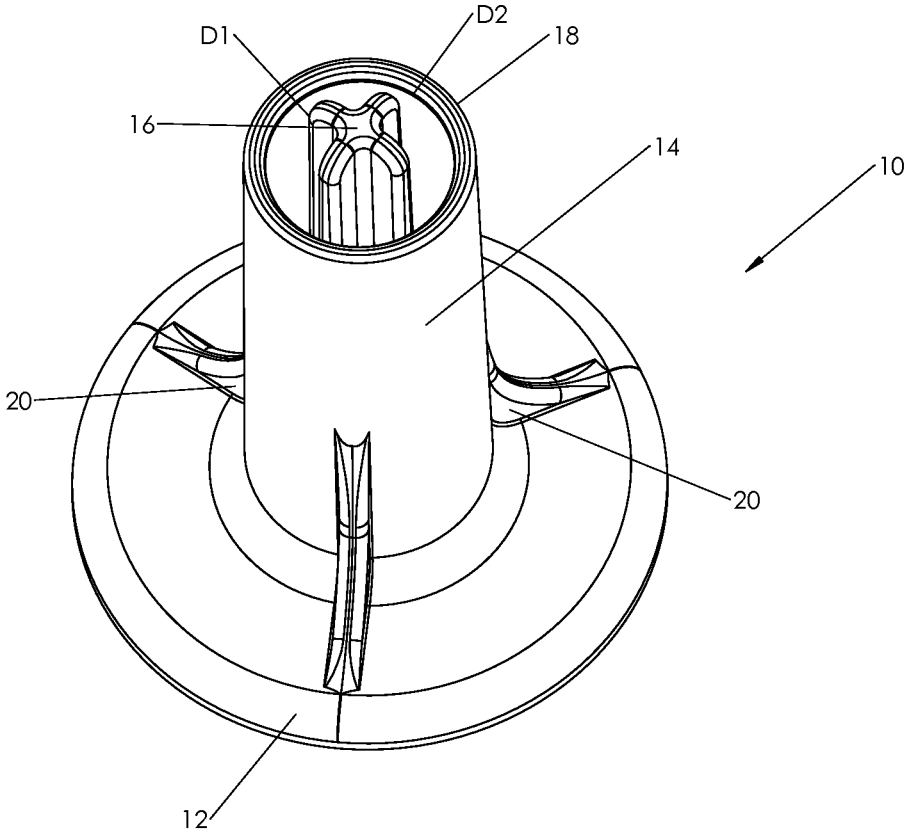
FIG. 1 is a perspective view of a balloon pedestal in accordance with this invention.
Figure 2A:
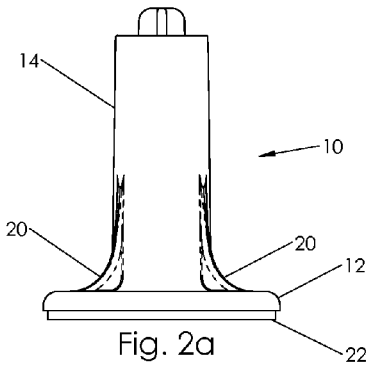
FIG. 2*a* is a side elevational view thereof, shown employing a first type of securing means.
Figure 2B:
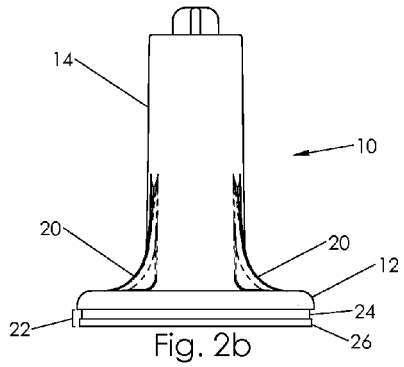
FIG. 2*b* is a side elevational view thereof, shown a pressure sensitive adhesive type securing means.

The present invention provides a fillable balloon weight and balloon pedestal display for the purpose of displaying one or more non-helium filled balloons. Referring now to FIGS. 1, 2*a*, and 2*b*, an embodiment of the balloon pedestal is shown and is designated by the numeral 10. Balloon pedestal 10 includes a base 12 and a balloon receiving structure 14. The balloon receiving structure 14 includes a male mounting structure 16 defining an outside mounting periphery D1 and a female mounting structure 18 defining an inside mounting periphery D2. In one embodiment the balloon receiving structure can be reinforced with multiple support ribs 20.

Figure 3A:
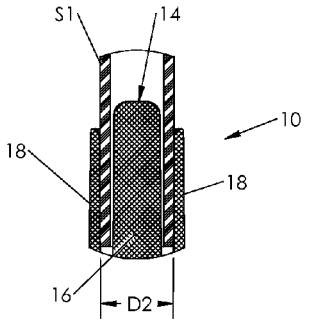
FIG. 3*a* is a schematic cross-sectional view showing a first stick engaging the balloon pedestal.
Figure 3B:
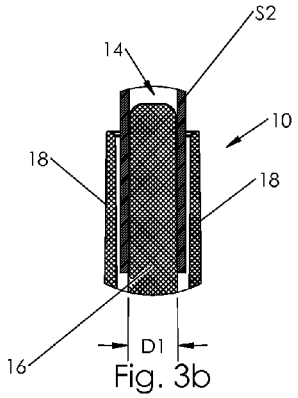
FIG. 3*b* is a schematic cross-sectional view showing a second stick engaging the balloon pedestal.

As shown in the cross section of FIG. 3*a*, the inside mounting periphery D2 of the female mounting structure 18 is shaped to selectively engage the outside periphery of a first balloon stick S1 and will thereby secure the first balloon stick S1 to the balloon pedestal 10 through a friction fit. As shown in the cross section of FIG. 3*b*, the outside mounting periphery D1 of the male mounting structure 16 is shaped to receive the inside periphery of a second balloon stick S2 and will thereby secure the second balloon stick S2 to the balloon pedestal 10 through a friction fit.

Figure 4:
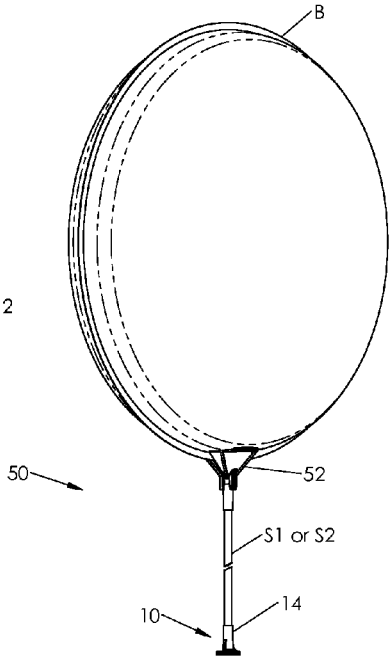
FIG. 4 is a side view of an embodiment of a balloon display unit in accordance with this invention, the balloon display unit employing a balloon pedestal in accordance with this invention.

As shown in FIG. 4, a balloon display unit 50 can be created by securing a balloon B to either a first balloon stick S1 or a second balloon stick S2, and then engaging the chosen stick with the appropriate female or male mounting structure of the balloon receiving structure 14 of the balloon pedestal 10. In one embodiment, the means of securing the balloon B to either a first balloon stick S1 or a second balloon stick S2 is by means of a balloon cup 52.

In FIG. 1, the male mounting structure 16 is shown to be a cross, the female mounting structure 18 is shown to be circular, and the base 12 is shown to be circular; however it should be appreciated that the invention is not limited to the male mounting structure 16, the female mounting structure 18 and the base 12 being in these particular shapes, as they can be any desired shape. The sticks S1 and S2 can engage the entire mounting peripheries or can engage only at a plurality of distinct locations. For example, a circular stick could be shaped to engage only the tips of the cross-shaped male mounting structure 16.

As shown in FIGS. 2*a* and 2*b*, the balloon pedestal 10 further includes a securing means 22 for securing the base 12 of the balloon pedestal 10 to a surface. In some embodiments the securing means 22 is selected from the group consisting of an adhesive system, a magnet system, and/or a snap-fit system. In a particular embodiment, the securing means 22 is an adhesive generally known as fugitive glue or credit card glue or, more colloquially, as booger glue. These fugitive glues are low-tack adhesives that produce a removable, non-permanent joining of two elements, and they do so with a minimal amount of damage caused to the elements when separated. In yet another embodiment, the securing means 22 is a pressure sensitive adhesive. FIG. 2*b* shows the securing means 22 employing a pressure sensitive adhesive 24 with a paper backing 26.

In one embodiment, when the securing means 22 is a magnet, the pedestal 10 can be secured to any magnetic metal surface. In another embodiment, when the securing means 22 is an adhesive system, the pedestal 10 can be secured to anything that the adhesive system is capable of adhering to. In another embodiment, where the sercuring means 22 is a snap-fit system, the base 12 of the balloon pedestal 10 fits into a receptacle through a snap-fit engagement that resists easy removal of the pedestal 10. In yet another embodiment, one or more of a balloon display unit 50 of this invention can be mounted to a portable display base to provide a balloon display, as will be next described. By "portable" it is meant that the base can be readily carried around by an individual. It is not sufficient for purposes of satisfying the term "portable" that something is merely capable of being transported from one place to another. "Portable" connotes that the item is readily capable of and intended to be easily moved by an individual from one location to another.

Figure 5:
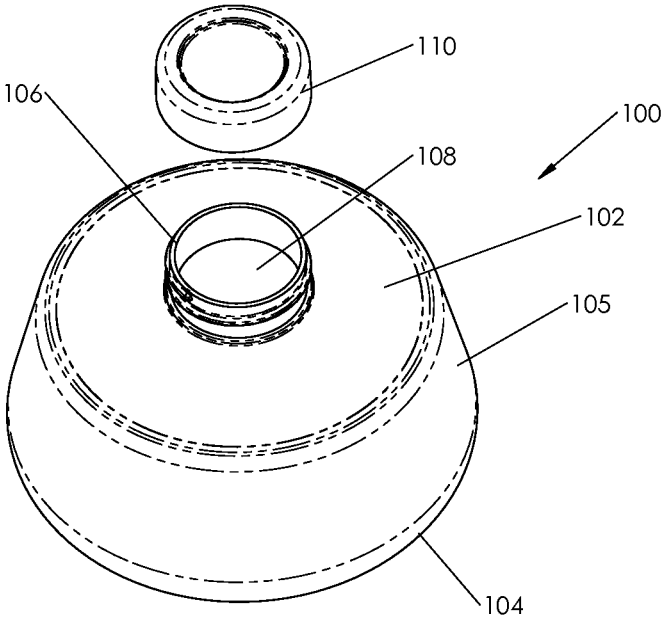
FIG. 5 is a perspective view of an embodiment of a display base in accordance with this invention.

Referring now to FIG. 5, a first embodiment of a display base is shown and designated by the numeral 100. Display base 100 includes an annular top mounting surface 102 opposite a base 104 and joined by a sidewall 105. An opening 106 in the top mounting surface 102 provides access to an interior volume 108 of the display base 100 and establishes the annular nature of the annular top mounting surface 102. The top mounting surface 102 is shown to be annular but it should be appreciated that the top mounting surface 102 can provide for other peripheral shapes containing central voids, such as opening 106. A cap 110 selectively closes off the opening 106 of the display base 100 to close access to the interior volume 108 of the display base 100. The interior volume 108 is selectively filled with a mass (not shown) to weigh down the display base 100.

Figure 6:
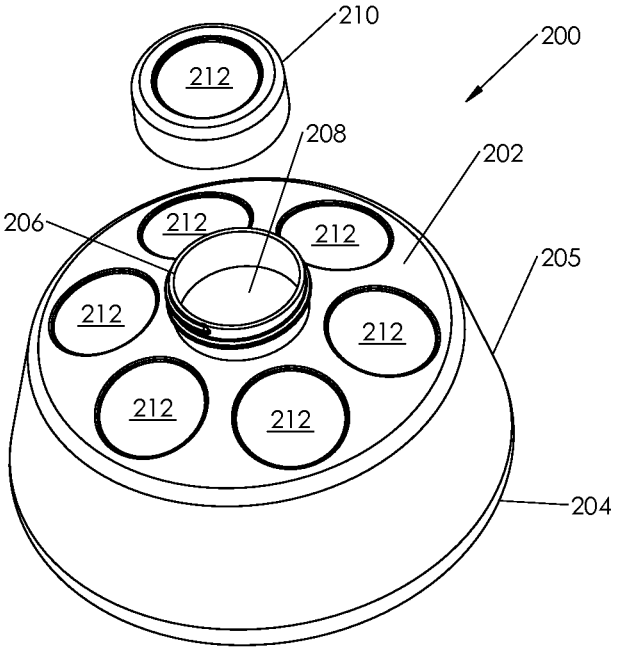
FIG. 6 is a perspective view of another embodiment of a display base in accordance with this invention.

A second embodiment of a display base is shown in FIG. 6 and designated by the numeral 200, wherein like parts as compared to the embodiment of FIG. 5 receive like numerals though increased by 100. Display base 200 includes an annular top mounting surface 202 opposite a base 204 and joined by a sidewall 205. An opening 206 in the top mounting surface 202 provides access to an interior volume 208 of the display base 200 and establishes the annular nature of the annular top mounting surface 202. The top mounting surface 202 is shown to be annular but it should be appreciated that the top mounting surface 202 can provide for other peripheral shapes containing central voids, such as opening 206. A cap 210 selectively closes off the opening 206 of the display base 200 to close access to the interior volume 208 of the display base 200. In some embodiments, such as that shown in FIG. 6, the cap 210 includes a pedestal receipt 212 as well. The interior volume 208 is selectively filled with a mass (not shown) to weigh down the display base 200. The display base 200 is similar to the display base 100 shown in FIG. 5, except that the display base 200 of FIG. 6 has pre-determined pedestal receipts 212 on the annular top mounting surface 202. The pre-determined pedestal receipts 212 have the ability to receive a balloon pedestal at a pre-determined location on the annular top mounting surface 202 of the container 200.

In some embodiments, the display bases 100 and 200 are made of a clear plastic or other clear material such that the mass weighing down either display base 100 or 200 may be viewed. In yet another embodiment, the display bases 100 and 200 are made of a colored plastic or other colored material which is transparent such that the mass weighing down either display base 100 or 200 may be viewed In particular embodiments, they are made from clear polyethylene teraphthalate (PET). The mass used to weigh down the display bases (if necessary) can be anything from water, rocks, coins, sand or any item providing mass. In other embodiments, the display bases are opaque, and in yet other embodiments they are made from a biodegradable/compostable plastic like PLA (polylactic acid) or from olefins such as polypropylene, polyethylene, and polycarbonate. In particular embodiments, the mass is candy or some other novelty or gift item that may be generally associated with parties and celebrations that are often decorated with balloons. The mass is preferably made up of multiple small items or other materials that can be used to fill the display bases to a selected degree, thus affecting a selected mass and decorative effect. When empty, the display bases 100 or 200 are low in weight such that transport costs are low and they can be made to be high in weight when filled with a mass. In a particular embodiment, when empty, the display bases 100 or 200 weigh about 30-grams and weighs around 600-grams when filled with water.

Figure 7:
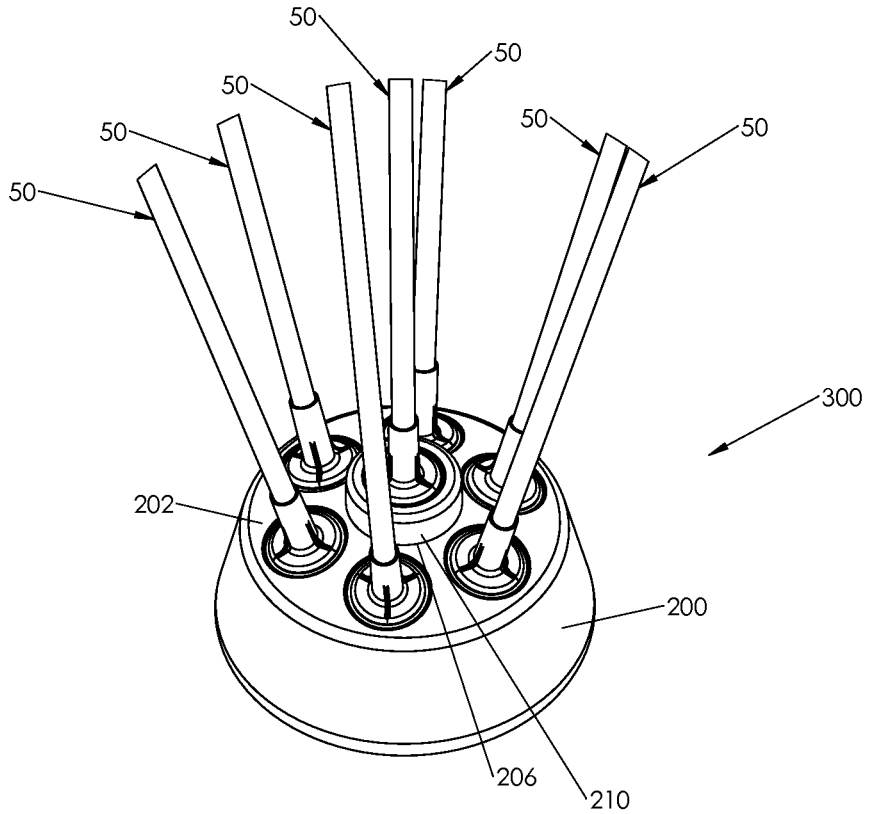
FIG. 7 is a perspective view of an embodiment of a balloon display in accordance with this invention.
Figure 8:
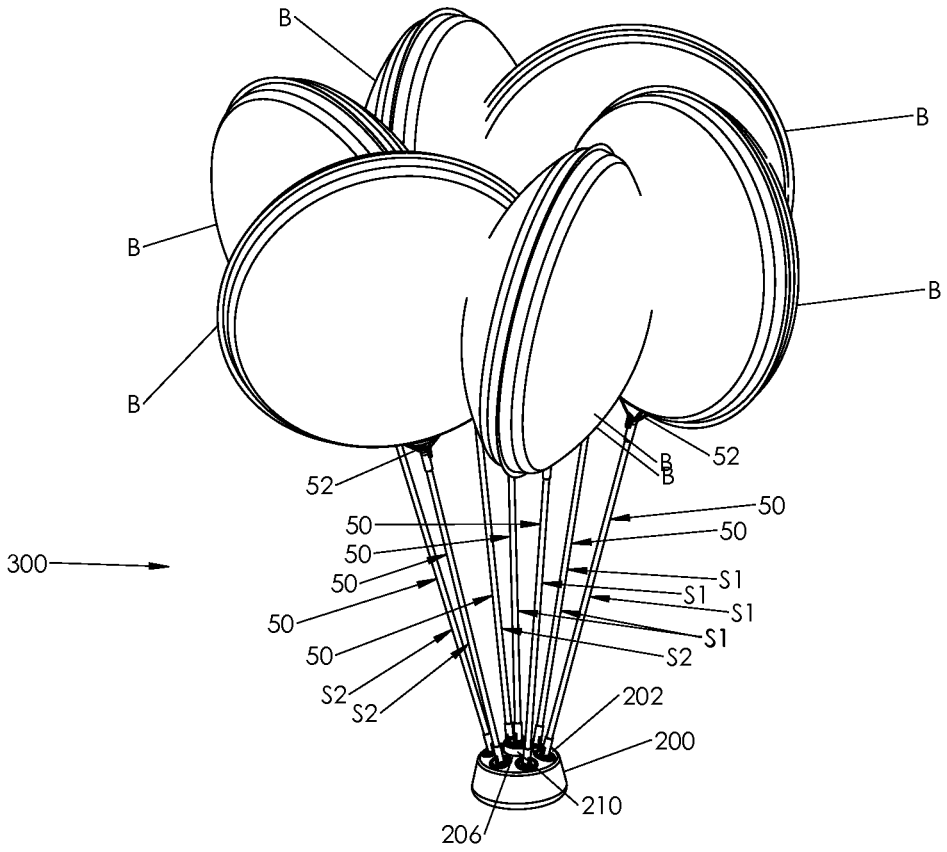
FIG. 8 is a perspective view of another embodiment of a balloon display in accordance with this invention.

In accordance with this invention, one or more balloon display units such as unit 50 may be secured to a selected display base, such as either base 100 or base 200 to create a balloon display. Herein, an embodiment employing display base 200 is focused upon; though it will be readily apparent how a balloon display could be formed using the display base 100. Referring now to FIGS. 7 and 8, a balloon display is shown and is designated by the numeral 300. The balloon display 300 is created by the securing of one or more balloon display units 50 to the top mounting surface 202 of display base 200, particularly at the pedestal receipts 212. Per the disclosure above regarding the pedestals, the attachment may be achieved by any means, and the previously mentioned magnet (by making the top mounting surface of metal), fugitive glue, pressure sensitive adhesive or other type of adhesive system. Balloon receipts 212 could also be formed to engage with base 12 through a snap fit as generally introduced above. It should be appreciated that although FIG. 8 shows the use of balloon cups 52 to secure balloons B to balloon sticks S1 or S2, any means can be employed to secure the balloons to the cups. The cap 210 of the display base 200 selectively closes off the opening 206 to close access to the interior volume of the display base 200. The use of balloon display 300 allows retailers to display an arrangement of multiple balloons without filling said balloons with helium. If helium was used, retailers would either have to spray the interior of the balloons with a relatively expensive spray that serves to frustrate the escape of the helium from the balloon or the would have to periodically re-fill the balloons with helium as they deflate, typically daily. By using balloon display 300 to display multiple balloons, retailers will cut costs and be able to have a more permanent display as compared to previously known balloon displays and balloon displaying methods employing helium.

Notably, display base 100 would be employed in much the same way, though pre-defined pedestal receipts would not be used. Instead, the pedestals would be secured at the user's choice. Also, the caps such as 110 and 210 may be avoided in some embodiments, the balloon base just providing a mounting surface for pedestals bases.

In light of the foregoing, it should be appreciated that the present invention significantly advances the art by providing a fillable balloon weight and balloon pedestal display that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A balloon display unit comprising:

a balloon and a balloon pedestal including:

a base and a balloon stick receiving structure extending from said base, said balloon stick receiving structure including:

a male mounting structure defining an outside mounting periphery, and a female mounting structure defining an inside mounting periphery, wherein said inside mounting periphery of said female mounting structure is shaped to selectively engage an outside periphery of a first balloon stick and thereby secure said first balloon stick to said balloon pedestal, and wherein said outside mounting periphery of said male mounting structure is shaped to selectively engage an inside periphery of a second balloon stick and thereby secure said second balloon stick to said balloon pedestal; wherein said first balloon stick selectively engages only said female mounting structure and said second balloon stick selectively engages only said male mounting structure; and wherein one of said first balloon stick or said second balloon stick has said balloon secured thereto and is engaged with said balloon stick receiving structure.

2. The balloon display unit of claim 1, further comprising a means for securing said base of said balloon pedestal to a surface.

3. The balloon display unit of claim 2, wherein said means for securing said base is selected from the group consisting of a snap fit system, an adhesive system and a magnet system.

4. The balloon display unit of claim 3, wherein said means for securing said base is a pressure sensitive adhesive.

5. The balloon display unit of claim 1, wherein said balloon is a non-helium filled balloon.

6. A balloon display comprising:

a display base having a planar exterior mounting surface; and a balloon display unit removably secured to said exterior mounting surface, said balloon display unit comprising:

a balloon pedestal including:

a planar base, and a balloon stick receiving structure extending from said base, said balloon receiving structure including a male mounting structure defining an outside mounting periphery and a female mounting structure defining an inside mounting periphery, a balloon stick engaged with one of said outside or inside mounting peripheries; and a non-helium filled balloon secured to said balloon stick.

7. The balloon display of claim 6, wherein said planar exterior mounting surface is an upwardly facing mounting surface opposite a base of said display base, said planar exterior mounting surface including an opening and said display base including a cap, said cap selectively closing off said opening to close access to an interior volume of said container, wherein said interior volume is selectively filled with a mass to weigh down said container.

8. The balloon display of claim 6, wherein said planar exterior mounting surface has a plurality of pre-determined pedestal receipts to receive said planar base of said balloon pedestal at various locations on said planar exterior mounting surface.

9. The balloon display of claim 7, wherein said cap has the ability to receive a planar base of a balloon pedestal.

10. The balloon display of claim 7, wherein said opening is defined in said planar exterior mounting surface.

11. The balloon display of claim 6, wherein said non-helium filled balloon is secured to said balloon stick by a balloon cup.

12. The balloon display of claim 6, wherein said balloon display unit is removably secured to said exterior mounting surface by a pressure sensitive adhesive.

13. A balloon display comprising:

a. a portable display base having an exterior mounting surface;

b. at least one balloon pedestal;

c. at least one balloon stick; and d. at least one non-helium filled balloon;

wherein said at least one non-helium filled balloon is secured to said at least one balloon stick; wherein said at least one balloon stick is received by said at least one balloon pedestal, wherein said at least one balloon pedestal is removably secured to said display base at said exterior mounting surface and wherein said portable display base comprises a. a container providing said exterior mounting surface, said exterior mounting surface being an upwardly facing mounting surface with an open end opposite a base of said container; said open end providing access to an interior volume of said container, and b. a cap, said cap closing off access to said interior volume of said container;

wherein said interior volume of said container has the ability to be filled with a mass to weigh down said container; and wherein said exterior mounting surface has the ability to receive multiple balloon pedestals.

14. The balloon display of claim 13, wherein said at least one balloon pedestal comprises:

a. a pedestal base; and b. a balloon receiving structure;

wherein said balloon receiving structure comprises a. a male mounting structure; and b. a female mounting structure;

wherein said pedestal base includes a means of attaching said balloon pedestal to said exterior mounting surface of said container; wherein an inside mounting periphery of said female mounting structure is shaped to selectively engage an outside periphery of a first balloon stick; and wherein an outside mounting diameter of said male mounting structure is shaped to selectively engage an inside periphery of a second balloon stick 15. The balloon display of claim 14, wherein said means of attaching being selected from the group consisting of a snap fit system, an adhesive system and a magnet system.

16. The balloon display of claim 15, wherein said means of attaching is a pressure sensitive adhesive.

17. The balloon display of claim 13, wherein said exterior mounting surface of said container has pre-determined pedestal receipts to receive balloon pedestals.

18. The balloon display of claim 13, wherein said cap has the ability to receive a balloon pedestal.

19. The balloon display of claim 13, wherein a plurality of balloon pedestals are removably secured to said exterior mounting surface of said display base.

* * * * *